US007192656B1

(12) United States Patent
Tai

(10) Patent No.: US 7,192,656 B1
(45) Date of Patent: Mar. 20, 2007

(54) ZINC GALVANIZING METHOD FOR A SINGLE SURFACE OF A METAL TUBE

(76) Inventor: Ching-Ping Tai, No. 15, Dayou 3rd St., Daliao Township, Kaohsiung County (TW)

( * ) Notice: Subject to any disclaimer, the term of this patent is extended or adjusted under 35 U.S.C. 154(b) by 0 days.

(21) Appl. No.: 11/165,379

(22) Filed: Jun. 24, 2005

(51) Int. Cl.
*B32B 15/00* (2006.01)
*B22C 38/00* (2006.01)

(52) U.S. Cl. ..... 428/659; 148/533

(58) Field of Classification Search ..... None
See application file for complete search history.

(56) References Cited

U.S. PATENT DOCUMENTS

RE24,852 E * 8/1960 Armstrong et al. ..... 29/429
4,101,345 A * 7/1978 Hunter et al. ..... 148/253
4,120,997 A * 10/1978 Franks et al. ..... 148/518
4,487,672 A * 12/1984 Vrable ..... 205/731
5,849,382 A * 12/1998 Schneck ..... 428/36.91
2004/0214029 A1* 10/2004 Carey et al. ..... 428/647

FOREIGN PATENT DOCUMENTS

JP 52129636 A * 10/1977
JP 0428479 A * 1/1992

* cited by examiner

*Primary Examiner*—Lynne R. Edmondson
(74) *Attorney, Agent, or Firm*—Troxell Law Office, PLLC

(57) ABSTRACT

A zinc galvanizing method for a single surface of a metal tube includes a first step of preparing metal tubes, a second step of galvanizing the metal tubes, a third step of acid washing, a fourth step of washing the metal tubes with water, and a final fifth step of drying the metal tubes. Then only an inner surface or an outer surface of meal tube is galvanized for resisting corrosion. The metal tubes according to the invention can save the subsequent expenditure required for maintenance and treating rust, and possible to prolong their service life, and the method can be applied to steel tubes of any shape or size.

2 Claims, 6 Drawing Sheets

ZINC GALVANIZING METHOD FOR A SINGLE SURFACE OF A METAL TUBE

BACKGROUND OF THE INVENTION

1. Field of the Invention

This invention relates to a zinc galvanizing method for a single surface of a metal tube, particularly to one provided with various methods for option by users, possible to reduce subsequent expenditure required for maintaining the metal tube.

2. Description of the Prior Art

Nowadays metal tubes are indispensable for industries, such as for chemical factories, accommodations located near seaside or very humid locations where corrosion is very prevalent. It is conventional that metal tubes are galvanized with zinc, as shown in FIG. 1, and one of the zinc galvanized metal tubes has the inner and the outer surface 120 and 121 of a metal tube 1 galvanized, and another is one having both the inner and the outer surface 120 and 121 not galvanized. So there is no option for using a metal tube with only one surface, the inner or the outer, galvanized. For example, if a liquid or gas to flow through a metal tube can give rise to a chemical reaction with a zinc galvanized layer, the metal tube galvanized on both the inner and the outer surface is impossible to be used, only the metal tube with no galvanization is possible. But these kind of metal tubes should be sprayed with or painted with an anti-corrosion substance to prevent them from corroding.

SUMMARY OF THE INVNETION

This invention has been devised to offer a zinc galvanizing method for a single surface of a metal tube, to make a metal tube with only one surface galvanized, the inner or the outer surface so as to be optionally used for preventing the metal tube from getting corrosion.

The feature of the method according to the invention is to galvanizing both the inner and the outer surface of a metal tube first, and to acid washing and removing either of the two surfaces with strong acid solution, and then washing with water the metal tube to remove miscellaneous matter off the metal tube.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
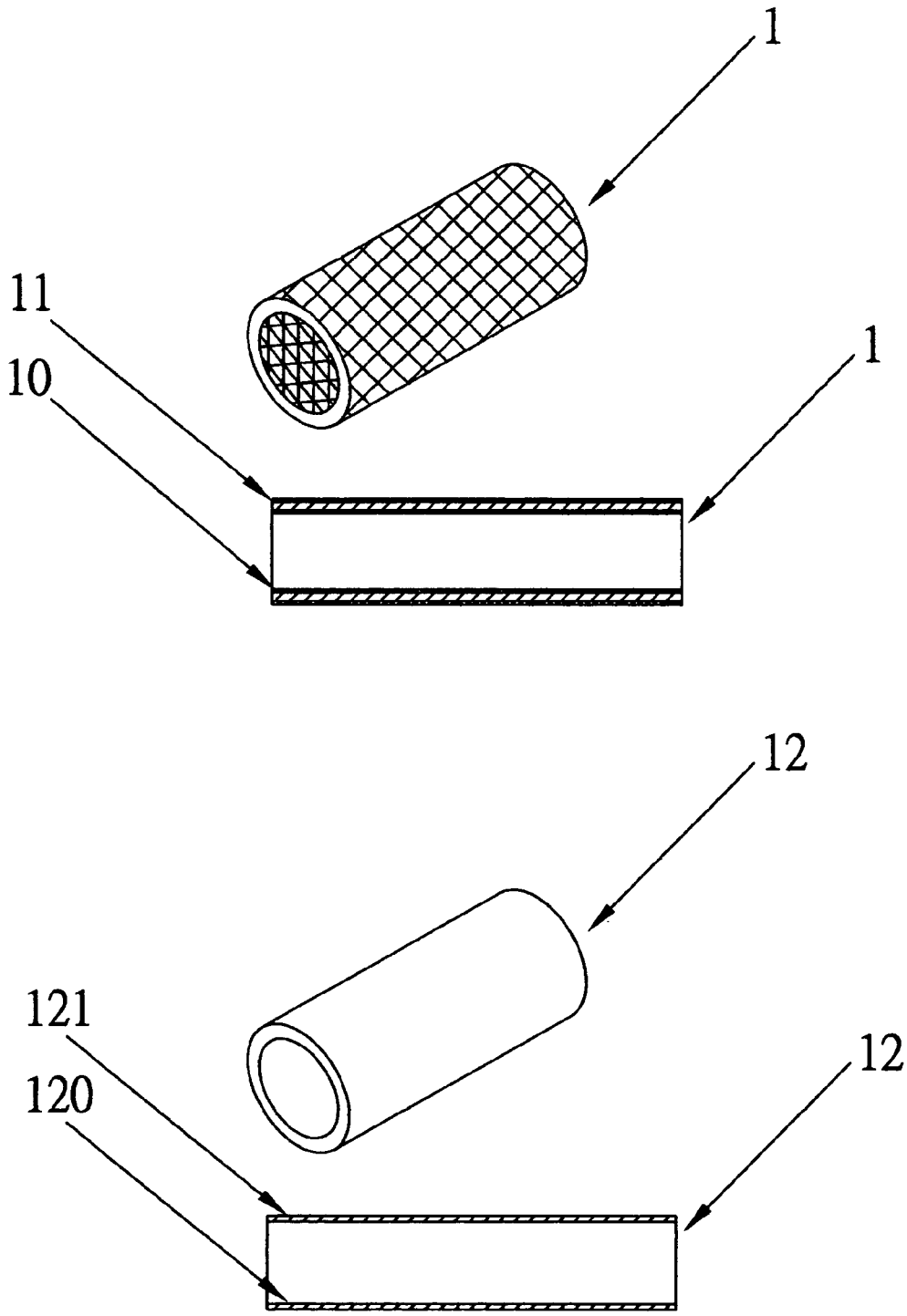
Fig.1 Prior Art
FIGS. 1*a* and 1*b* are cross-sectional views of conventional metal tubes galvanized.
Figure 2:
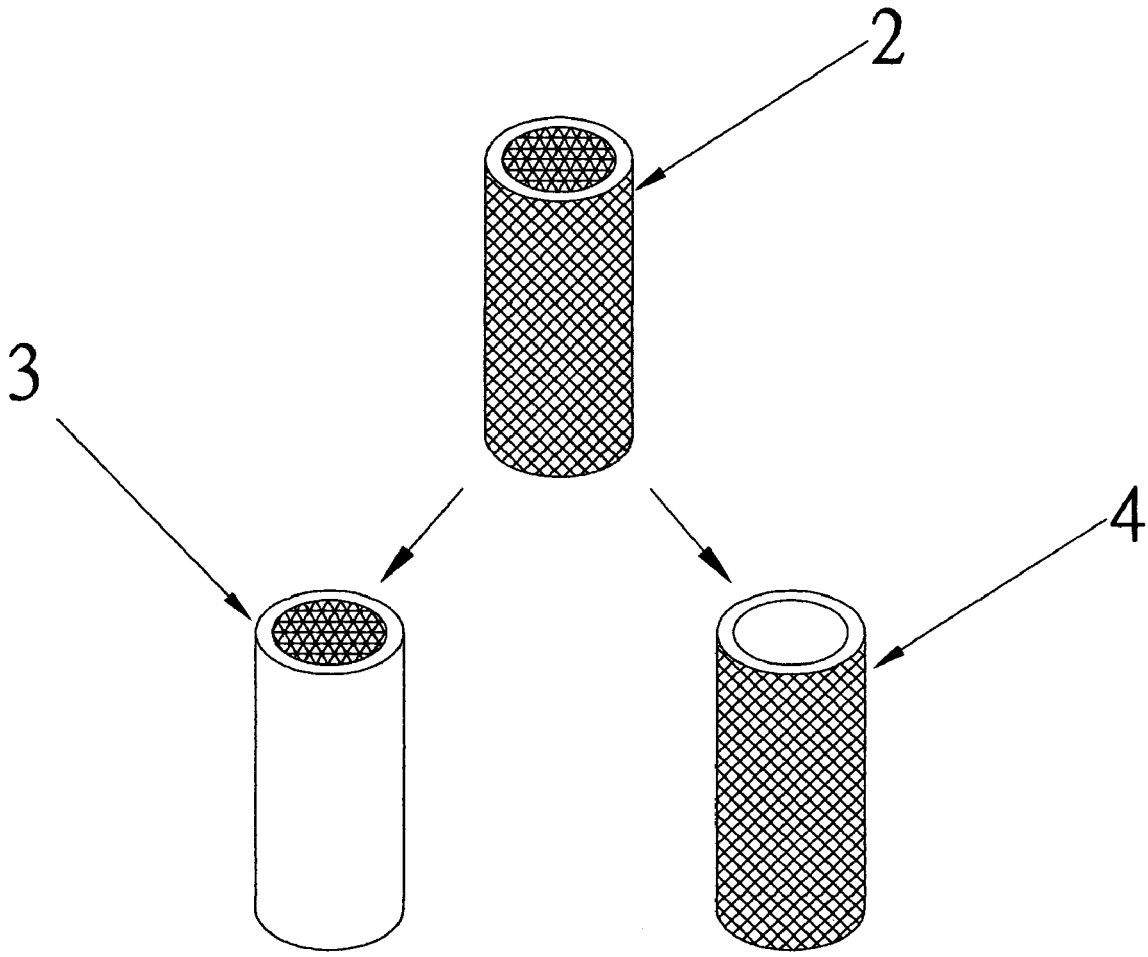
FIG. 2 is a perspective view of metal tubes galvanized by a zinc galvanizing method in the present inventin.
Figure 3A:
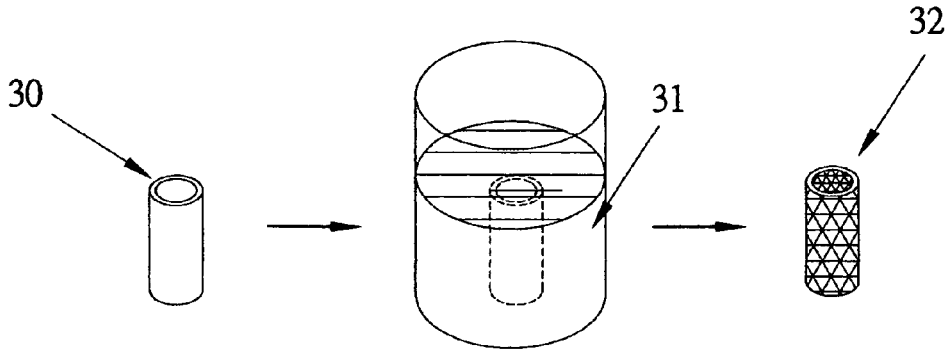
FIGS. 3*a*, 3*b* and 3*c* are perspective views of three processes of a metal tube with its inner surface galvanized by the zinc galvanizing method in the present invention.
Figure 3B:
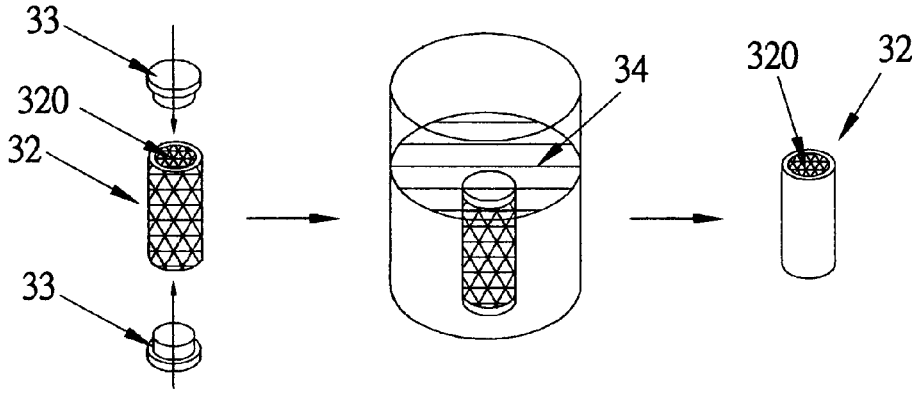
Figure 3C:
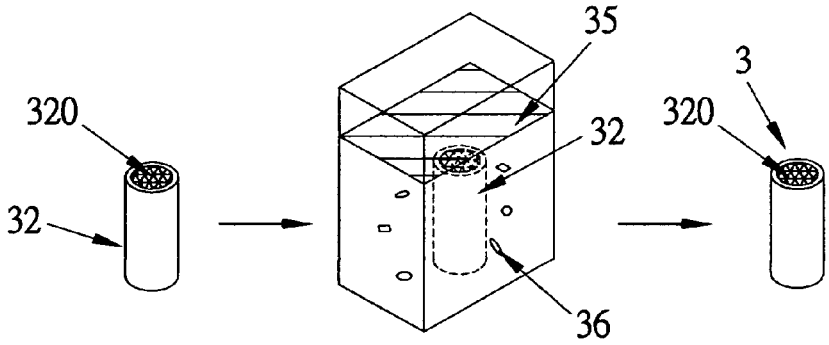
Figure 4:
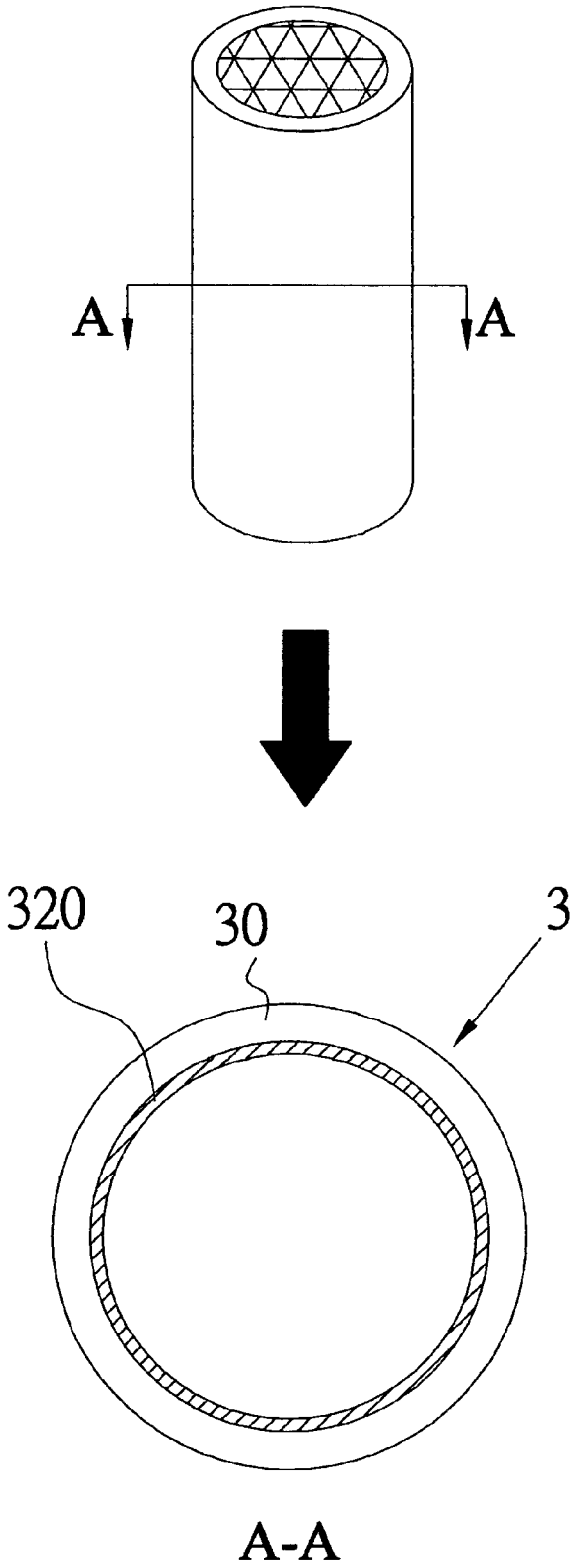
FIG. 4 is cross-sectional view of a metal tube with its inner surface galvanized by the zinc galvanizing method in the present invention.

A preferred embodiment of a zinc galvanizing method for s single surface of a metal tube in the present invention, as shown in FIGS. 3*a*, 3*b*, 3*c* and 4, includes five steps of processes, a first step of preparing a metal tube 30 with a seam or no seam, a second step of zinc galvanizing, a third step of washing the galvanized metal tube with strong acid, a fourth step of washing the metal tube finishing the third step, and a fifth step of drying the metal tube finishing the fourth step.

The second step includes several minor processes of immersing the metal tube 30 in liquid zinc in a container 31, and of carrying out galvanizing a zinc galvanized layer 320 on both the inner and the outer surface of the metal tube 32.

The third step is washing with strong acid by inserting a stopper 33 made of acid-resistant substance and to wash the outer surface of the metal tube so as to get rid of the zinc layer 320 galvanized on the outer surface only by means of a strong acid solution 34 of hydrochloric or sulfuric acid, acquiring the metal tube with only the inner surface galvanized only.

The fourth step is to wash the metal tube finishing the third step by immersing the tube in a water tank 35 and cleaning off the acid and miscellaneous matter 36 remained on the metal tube.

The fifth or the last step is to dry the water remained on the metal tube finishing the fourth step, and then to be wrapped up for storing or transporting.

Then, the metal tube 3 with only the inner surface galvanized with zinc can be applied to a tube route wherein a corrosive liquid flows therein, resisting corrosion caused by the liquid by means of the zinc galvanized layer 320.

Figure 5A:
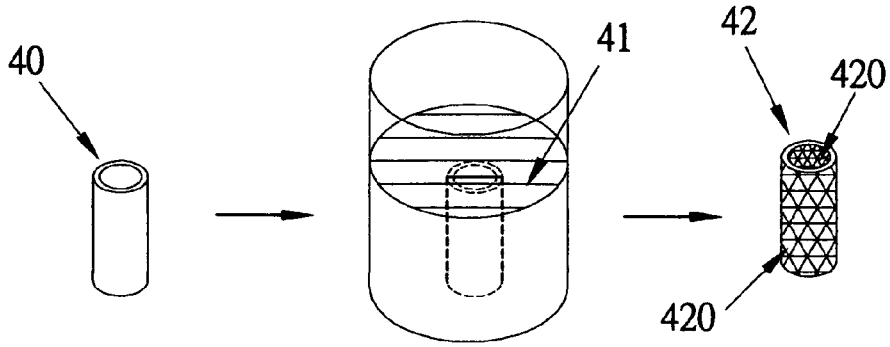
FIGS. 5*a*, 5*b* and 5*c* are perspective views of three processes of a metal tube with its outer surface galvanized by the zinc galvanizing method in the present invention; and, FIG. 6 is a cross-sectional view of a metal tube with its outer surface galvanized by the zinc galvanizing method in the present invention.
Figure 5B:
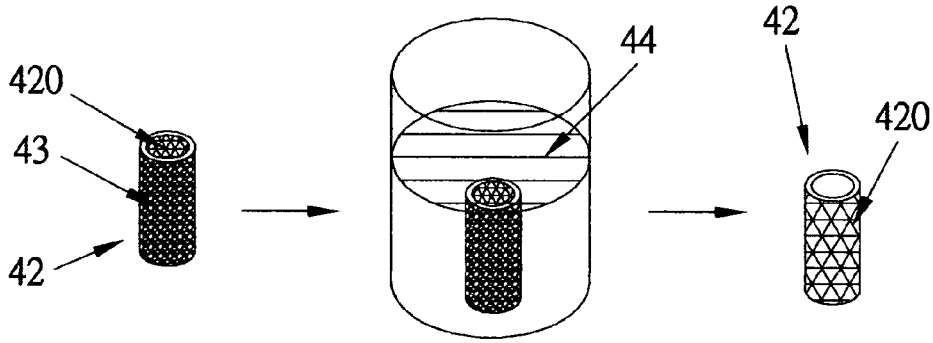
Figure 5C:
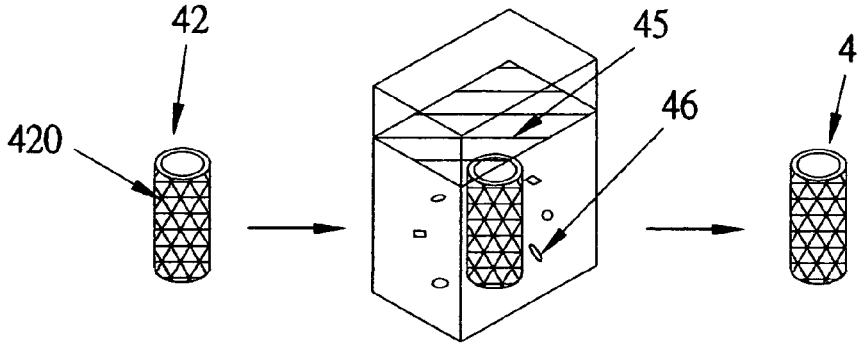
Figure 6:
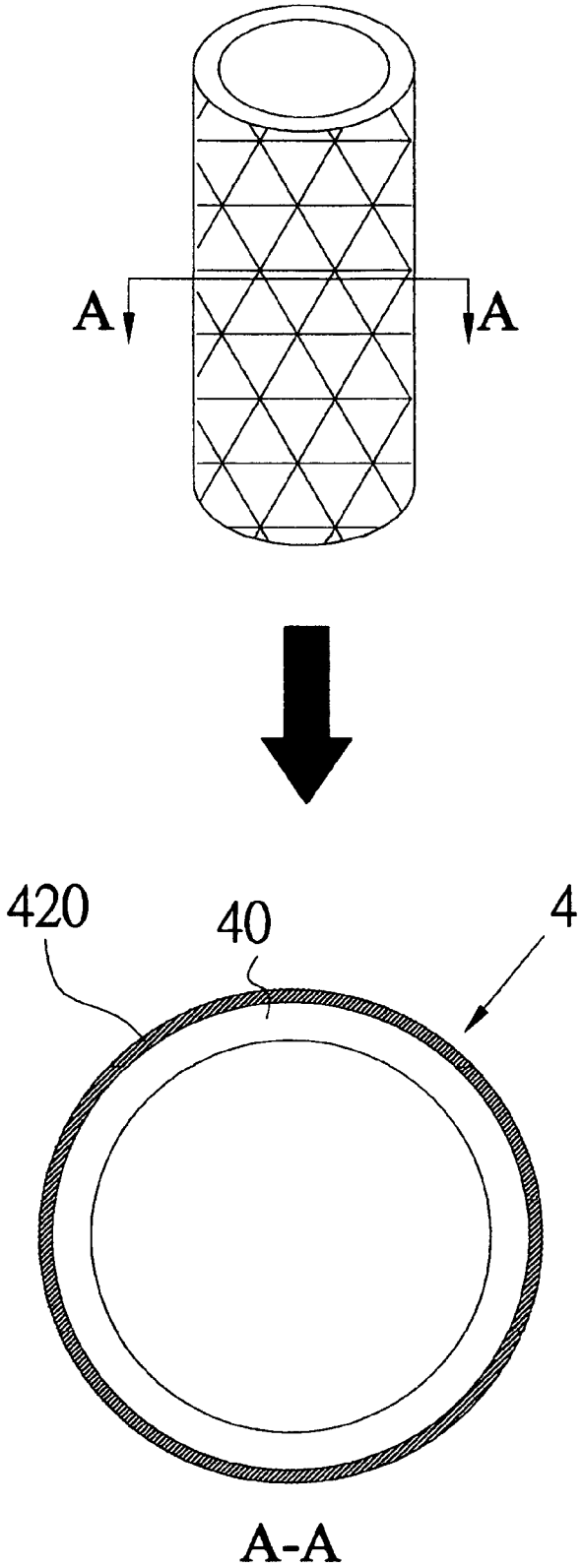

Next, FIGS. 5*a*, 5*b*, 5*c* and 6 show the zinc galvanizing method for forming a zinc galvanized layer 420 on the outer surface of a metal tube 40 only. This method includes five steps, and the first one is to prepare seamed or seamless metal tubes 40.

The second step includes minor ways of placing the metal tube 40 in liquid zinc 41 in a container, and of carrying cut galvanizing a zinc layer 420 on the two surfaces of a metal tube 42.

The third step is to wrap only the outer surface of the metal tube 42 finishing the second step with an acid-resistant material 43 such as PE, and then to wash it with strong acid solution 44 of hydrochloric acid or sulfuric acid for removing only the zinc layer 420 on the inner surface of the metal tube 42.

The fourth step is to wash with water the metal tube 42 finishing the third step by putting the metal tube 42 in a water tank 45, washing and removing all matters remained on the metal tube 4 after washing with the strong acid.

The fifth step is to dry the metal tube 4 finishing the fourth step for removing water remained on it and then to wrap it.

The chemical reacting formula of acid washing descried above is as follows.

When the strong acid is hydrochloric acid, $HCl(l)+Zn(s)\rightarrow ZnCl(s)+\frac{1}{2}H_2(g)$ (HCl(l) has a density 2%–32%);

When the strong acid is sulfuric acid, $H_2SO_4(l)+Zn(s)\rightarrow ZnSO_4(s)+\frac{1}{2}H_2(g)$ (The sulfuric acid $H_2SO_4(l)$ with the density 2%–99% is heated to 20° C.–80° C.)

As seen from the above description, a metal tube 4 with the outer surface only galvanized with a zinc layer 420 is made of a metal tube with both the inner and the outer surface galvanized first, and then the inner galvanized zinc layer is then removed by acid solution to leave the outer surface only galvanized with zinc for resisting erosion.

Then the metal tube with the outer surface galvanized with zinc can be used in a water tank, the locations near seaside, or corrosive sites, resisting exterior corrosion.

The metal tube available for this method in the invention may be seamed steel tubes, seamless steel tubes, electrically welded steel tubes, helical steel tubes, etc. and the size and the shape of the steel tubes may not be limited, even as large as those having a diameter of 68 inches, whether straight or bent. In addition, the zinc layer obtained by the method in the invention may have the thickness more than 610 $g/m^2$, meeting regulations of ASTM A-123, BS-729, JIS H-8641, and CNS series number 10007, sub-number H3116.

As the zinc galvanized layers may be affected by high temperature during welding process, and the zinc galvanized layer may give out noxious gas by high temperature during welding, the two ends of a metal tube to be galvanized with a zinc layer is in advance not to be galvanized for a certain area for welding so as to avoid harmful result. Or the two ends of a metal tube galvanized have to be ground off some portions of the zinc galvanized layer before welding.

The method according to the invention has the following advantages.

1. A metal tube with the inner surface only galvanized can be optionally used for a tube route for flowing of corrosive substance such as cool water.

2. A metal tube with the outer surface only galvanized can be optionally used in a water tank or a location near seaside or a corrosive site.

3. A metal tube according to the invention does not need to spray a corrosion resistant substance on the outer or the inner surface, not requiring any subsequent expenditure caused by inferior coupling or for treating rust possible to grow on the metal tube.

4. Its service life may be substantially long, not needing subsequent maintenance and lowering the cost.

5. Any steel tube can be treated by the method according to the invention, regardless of its shape, size, not limited by the outer appearance of material.

While the preferred embodiment of the invention has been described above, it will be recognized and understood that various modifications may be made therein and the appended claims are intended to cover all such modifications that may fall within the spirit and scope of the invention.

What is claimed is:

1. A zinc galvanizing method for a single surface of a metal tube, said method comprising:

a first step of material preparing: preparing seamed or seamless metal tubes;

a second step of zinc galvanizing: placing said metal tubes in a zinc solution and carrying out galvanizing a zinc layer on both the inner surface and the outer surface of said metal tubes;

a third step of washing with acid: washing and removing either of said zinc layer galvanized on the inner and the outer surface of said metal tubes finishing the second step, by using a strong acid solution;

a fourth step of washing with water: placing said metal tubes with only the inner or the outer surface galvanized with zinc finishing the third step and washing off miscellaneous matter remained on said metal tubes; and, a fifth step of drying: drying said metal tube finishing the fourth step for wrapping, wherein if only the inner surface of said metal tube is to be galvanized, with the outer surface not to be galvanized, said metal tube with both the inner and the outer surface already galvanized have the two end openings sealed with stoppers of acid resistant substance, and then is washed and removed the zinc layer galvanized on said outer surface with strong acid.

2. A zinc galvanizing method for a single surface of a metal tube, said method comprising:

a first step of material preparing: preparing seamed or seamless metal tubes;

a second step of zinc galvanizing: placing said metal tubes in a zinc solution and carrying out galvanizing a zinc layer on both the inner surface and the outer surface of said metal tubes;

a third step of washing with acid: washing and removing either of said zinc layer galvanized on the inner and the outer surface of said metal tubes finishing the second step, by using a strong acid solution;

a fourth step of washing with water: placing said metal tubes with only the inner or the outer surface galvanized with zinc finishing the third step and washing off miscellaneous matter remained on said metal tubes; and, a fifth step of drying: drying said metal tube finishing the fourth step for wrapping, wherein if only said inner surface of said metal tube is not to be galvanized with a zinc layer, said outer surface of said metal tube is wrapped with acid resistant substance and then said inner surface already galvanized with a zinc layer is washed and removed said zinc layer galvanized thereon.

* * * * *